US008517202B1

(12) United States Patent
Lord et al.

(10) Patent No.: US 8,517,202 B1
(45) Date of Patent: Aug. 27, 2013

(54) BEVERAGE BIN COOLER

(76) Inventors: Jon Paul Lord, Arlington, TX (US); Stephen Glen Sassman, Mansfield, TX (US)

( * ) Notice: Subject to any disclaimer, the term of this patent is extended or adjusted under 35 U.S.C. 154(b) by 253 days.

(21) Appl. No.: 13/049,741

(22) Filed: Mar. 16, 2011

Related U.S. Application Data

(60) Provisional application No. 61/314,495, filed on Mar. 16, 2010.

(51) Int. Cl.
*B65D 21/02* (2006.01)

(52) U.S. Cl.
USPC ..... 220/495.11; 220/571; 220/23.87

(58) Field of Classification Search
USPC ..... 62/457.5; 220/495.01, 495.11, 495.08, 220/495.06, 23.87, 571; 206/495.5; 40/312
See application file for complete search history.

(56) References Cited

U.S. PATENT DOCUMENTS 495,949 A * 4/1893 Fear ..... 206/45.28
1,797,451 A * 3/1931 Staton ..... 220/592.04
4,895,250 A * 1/1990 Schifrin ..... 206/223
6,234,351 B1 * 5/2001 Wilcox ..... 222/95
6,629,620 B1 * 10/2003 Freeman ..... 220/23.88
2001/0040166 A1 * 11/2001 Pietrantoni ..... 220/592.26

* cited by examiner

*Primary Examiner* — Stephen Castellano
(74) *Attorney, Agent, or Firm* — Jack D. Stone, Jr., Esq.; Scheef & Stone, L.L.P.

(57) ABSTRACT

A kit for displaying beverages, includes a first corrugated fiberboard for supporting a bin within a cavity of the first corrugated fiberboard. A second corrugated fiberboard displays at least one of words, images, and shapes, and is capable of being removably mounted to the first corrugated fiberboard. A third corrugated fiberboard supports the articles placed in the bin, and inserts within the cavity of the first corrugated fiberboard. A fourth corrugated fiberboard receives the articles therein, and comprises a portion of the bin and inserts within the cavity of the first corrugated fiberboard supported by the third corrugated fiberboard and secured by the first corrugated fiberboard. A liner is inserted in the first corrugated fiberboard over the fourth corrugated fiberboard, a portion of the liner extending through the fourth corrugated fiberboard, the third corrugated fiberboard, the second corrugated fiberboard, and the first corrugated fiberboard, allowing a coolant placed within the liner to drain from the bin after cooling the articles.

12 Claims, 6 Drawing Sheets

BEVERAGE BIN COOLER

CROSS-REFERENCE TO RELATED APPLICATIONS

This application claims the benefit of U.S. Provisional Application No. 61/314,495, filed Mar. 16, 2010, which application is hereby incorporated herein by reference, in its entirety.

TECHNICAL FIELD

The invention relates generally to the cooling and display of beverages and other items and, more particularly, to a disposable cooler beverage bin.

SUMMARY

The present invention provides a kit for displaying beverages, and includes a first corrugated fiberboard for supporting a bin within a cavity of the first corrugated fiberboard. A second corrugated fiberboard displays at least one of words, images, and shapes, and is capable of being removably mounted to the first corrugated fiberboard. A third corrugated fiberboard supports the articles placed in the bin, and inserts within the cavity of the first corrugated fiberboard. A fourth corrugated fiberboard receives the articles therein, and comprises a portion of the bin and inserts within the cavity of the first corrugated fiberboard supported by the third corrugated fiberboard and secured by the first corrugated fiberboard. A liner is inserted in the first corrugated fiberboard over the fourth corrugated fiberboard, a portion of the liner extending through the fourth corrugated fiberboard, the third corrugated fiberboard, the second corrugated fiberboard, and the first corrugated fiberboard, allowing a coolant placed within the liner to drain from the bin after cooling the articles.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

In the following discussion, numerous specific details are set forth to provide a thorough understanding of the present invention. However, it will be obvious to those skilled in the art that the present invention may be practiced without such specific details. Additionally, for the most part, details concerning fiberboard manufacturing, creasing, and cutting and the like have been omitted inasmuch as such details are not considered necessary to obtain a complete understanding of the present invention, and are considered to be within the skills of persons of ordinary skill in the relevant art.

Figure 1:
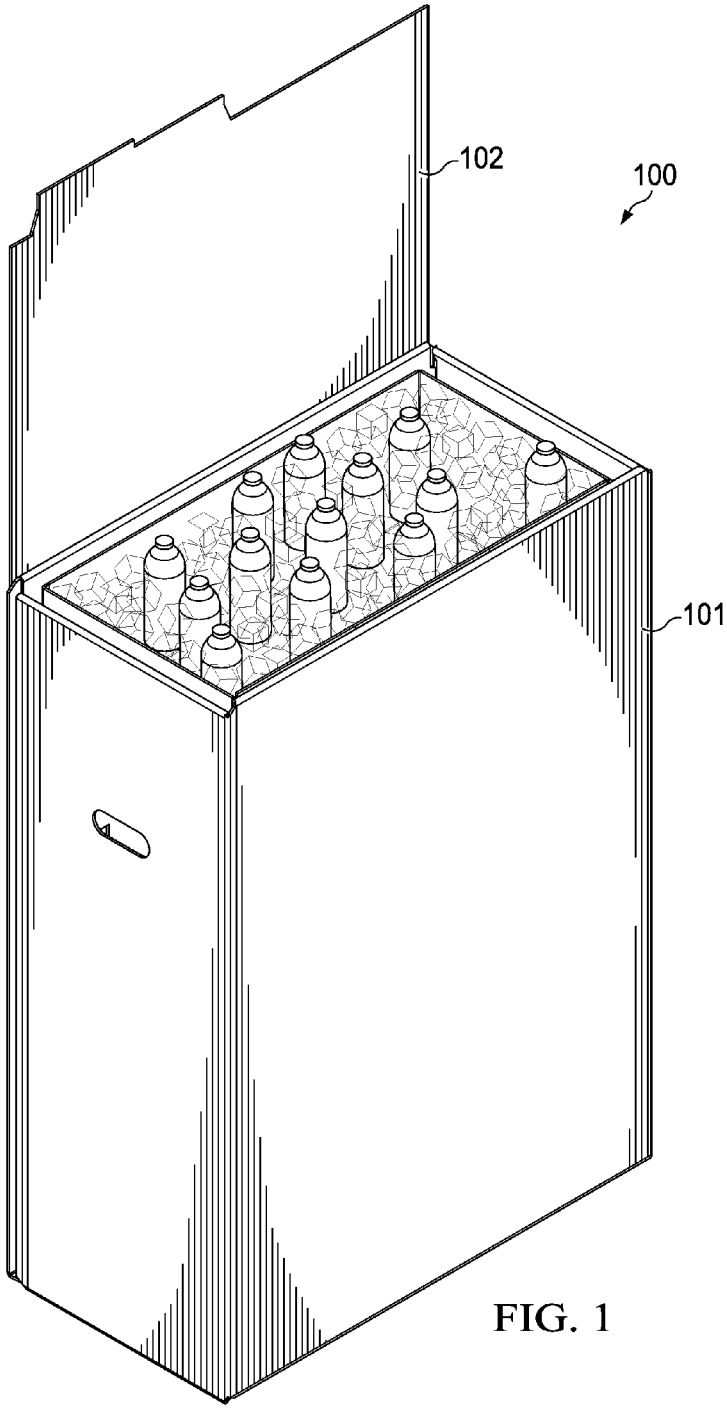
FIG. 1 is an isometric view of a beverage bin embodying features of the present invention.

Referring to FIG. 1 of the drawings, there is exemplified a system 100 for displaying, cooling, and advertising articles for sale, such as beverages. The system 100 preferably comprises a cooler base 101 and a cooler header 102. In the illustrated embodiment, the cooler base 101 comprises a portion of a bin for storing and cooling beverages. The cooler base 101 further comprises one or more areas for displaying an image or advertisement. The cooler header 102 comprises an area of the system 100 for displaying an image or advertisement. Furthermore, the cooler header 102 secures or attaches to the cooler base 101 as described in more detail below. Preferably, the cooler base 101 and the cooler header 102 are comprised of corrugated fiberboard, although additional materials may be used.

Figure 2:
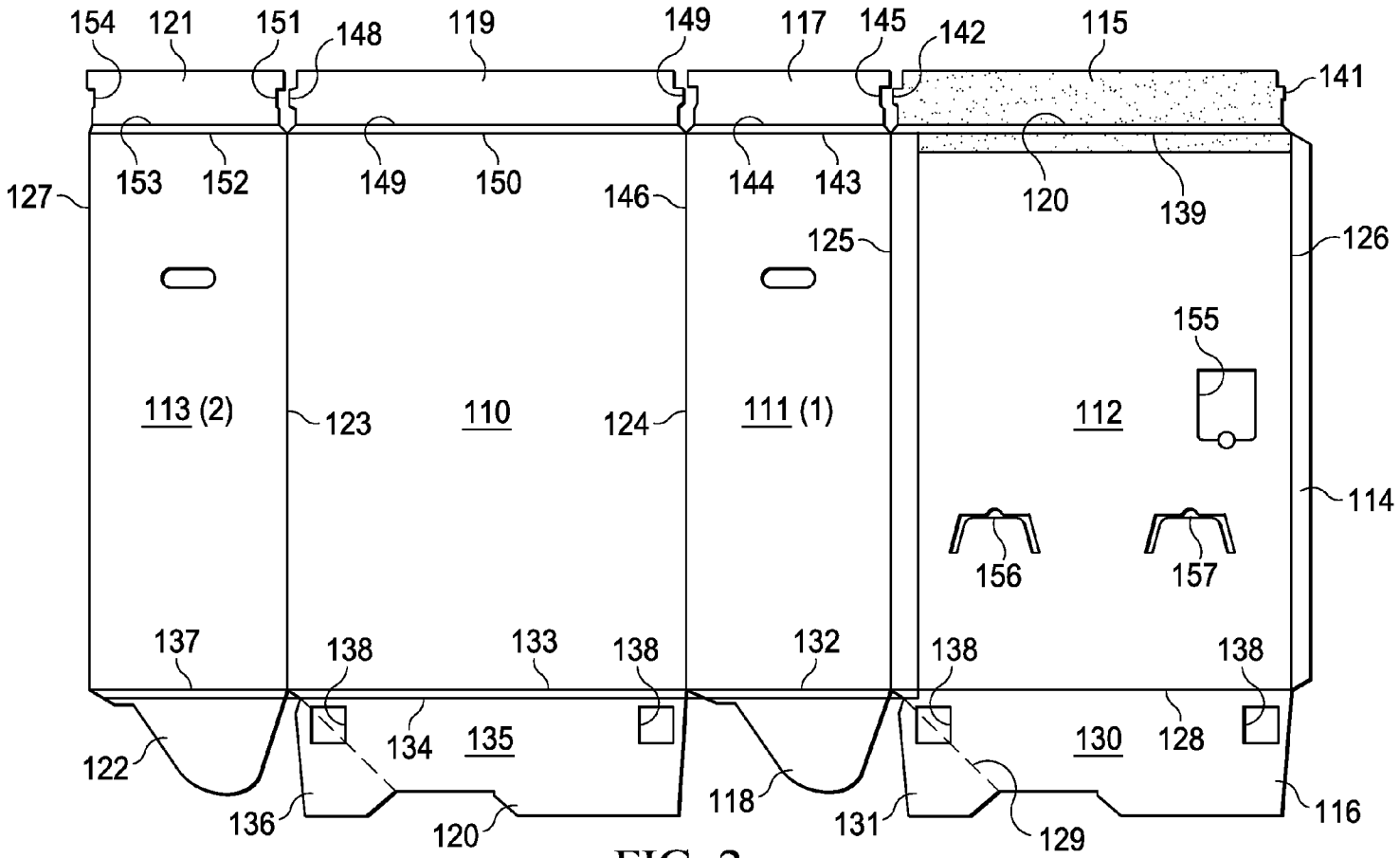
FIG. 2 is a plan view of one component of a disclosed embodiment of the present invention.

Referring now to FIG. 2, there is exemplified a single sheet of corrugated fiberboard used in the assembly of the cooler base 101. The single sheet of corrugated fiberboard is die cut and creased to form the following: a front wall 110, a first side wall 111, a back wall 112, a second side wall 113, an attachment flap 114, a back wall bin formation flap 115, a back wall bottom formation flap 116, a first side wall bin formation flap 117, a first side wall bottom formation flap 118, a front wall bin formation flap 119, a front wall bottom formation flap 120, a second side wall bin formation flap 121, and a second side wall bottom formation flap 122.

As illustrated, the first side wall 111, and the second side wall 113 comprise a pair of opposing side walls foldably attached along a first cooler base crease ("First CBC") 123 and a second cooler base crease ("Second CBC") 124 to the front wall 110. The back wall 112 is foldably attached along a third cooler base crease ("Third CBC") 125 to the first side wall 111 opposite the front wall 110. Finally, the attachment flap 114 foldably attaches to the back wall 112 along a fourth cooler base crease ("Fourth CBC") 126 opposite the first side wall 111. In the illustrated embodiment, folds are made along each of the First CBC 123, the Second CBC 124, the Third CBC 125, and the Fourth CBC 126 such that the front side of each wall does not face any other wall of the single sheet of corrugated fiberboard. These folds create the box like structure featured prominently in FIG. 1. An adhesive is applied to the front of attachment flap 114 and secured to the second side wall 113 along an edge 127 opposite the First CBC 123 of the front wall 110 securing the box like structure. This allows the cooler base 101 to quickly and easily move from a relatively flat storage configuration (not shown) to a box-like set-up configuration (FIG. 1) having a cavity.

The back wall bottom formation flap 116 folds away from the front of the corrugated fiberboard sheet of the cooler base 101 along a fifth cooler base crease ("Fifth CBC") 128 toward the cavity previously formed. In the illustrated embodiment, the back wall bottom formation flap 116 is creased along a sixth cooler base crease ("Sixth CBC") 129 forming a first portion back wall bottom formation flap 130, and a second portion back wall bottom formation flap 131. An adhesive is applied along the back of the second portion back wall bottom formation flap 131 and secured to the first side wall bottom formation flap 118 along an edge of the first side wall bottom formation flap 118 proximate to the back wall bottom formation flap 116. The first side wall bottom formation flap 118 folds away from the front of the corrugated fiberboard sheet of the cooler base 101 along a seventh cooler base crease ("Seventh CBC") 132 toward the cavity.

Similarly, the front wall bottom formation flap 120 folds away from the front of the corrugated fiberboard sheet comprising the cooler base 101 along an eighth cooler base crease ("Eighth CBC") 133 toward the cavity. In the illustrated embodiment, the front wall bottom formation flap 120 is creased along a ninth cooler base crease ("Ninth CBC") 134 forming a first portion front wall bottom formation flap 135, and a second portion front wall bottom formation flap 136. An adhesive is applied along the back of the second portion front wall bottom formation flap 136 and secured to the second side wall bottom formation flap 122 along an edge of the second side wall bottom formation flap 122 proximate to the front wall bottom formation flap 120. The second side wall bottom formation flap 122 folds away from the front of the corrugated fiberboard sheet of the cooler base 101 along a tenth cooler base crease ("Tenth CBC") 137 toward the interior previously formed. In the illustrated embodiment, the cooler base 101 folds along the cooler base creases described above between the storage configuration and set-up configuration (illustrated in FIG. 1).

In an embodiment, castors may be placed at castor locations 138 illustrated in FIG. 2.

Figure 5:
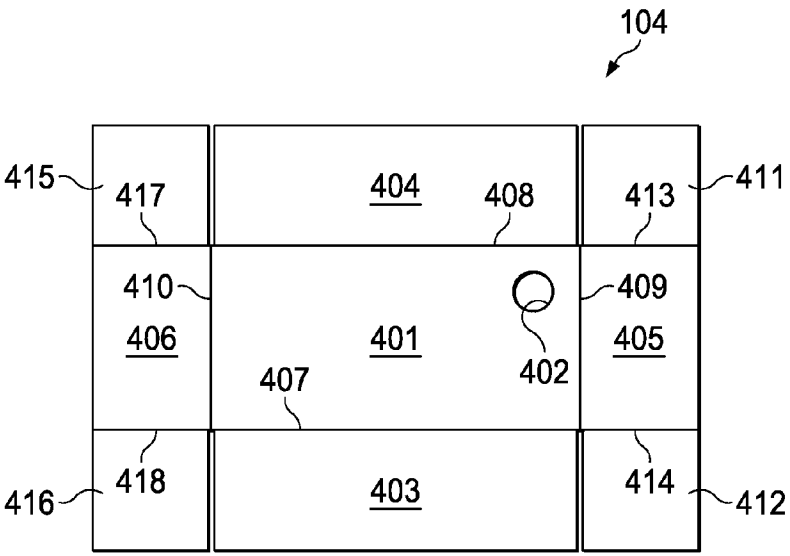
FIG. 5 is a plan view of one component of a disclosed embodiment of the present invention.

In the illustrated embodiment, the back wall bin formation flap 115 folds away from the front of the cooler base 101 along an eleventh cooler base crease 139, and again along a twelfth cooler base crease 140 to form a pocket (not shown) of a thickness of a bin 104 (FIG. 5). The back wall bin formation flap 115 further comprises a first back wall insert 141, and a second back wall insert 142. Similarly, the first side wall bin formation flap 117 folds away from the front of the cooler base 101 along a thirteenth cooler base crease 143, and again along a fourteenth cooler base crease 144 to form a pocket (not shown) of a thickness of the bin 104 (FIG. 5). The first side wall bin formation flap 117 further defines a first first side wall slot 145, and a second first side wall slot 146.

The front wall bin formation flap 119 folds away from the front of the cooler base 101 along a fifteenth cooler base crease 149, and again along a sixteenth cooler base crease 150 to form a pocket (not shown) of a thickness of the bin 104 (FIG. 5). The front wall bin formation flap 119 further comprises a first front wall insert 147, and a second front wall insert 148. Similarly, the second side wall bin formation flap 121 folds away from the front of the cooler base 101 along a seventeenth cooler base crease 152, and again along an eighteenth cooler base crease 153 to form a pocket (not shown) of a thickness of the bin 104 (FIG. 5). The second side wall bin formation flap 121 further defines a first second side wall slot 151, and a second second side wall slot 154.

Figure 6A:
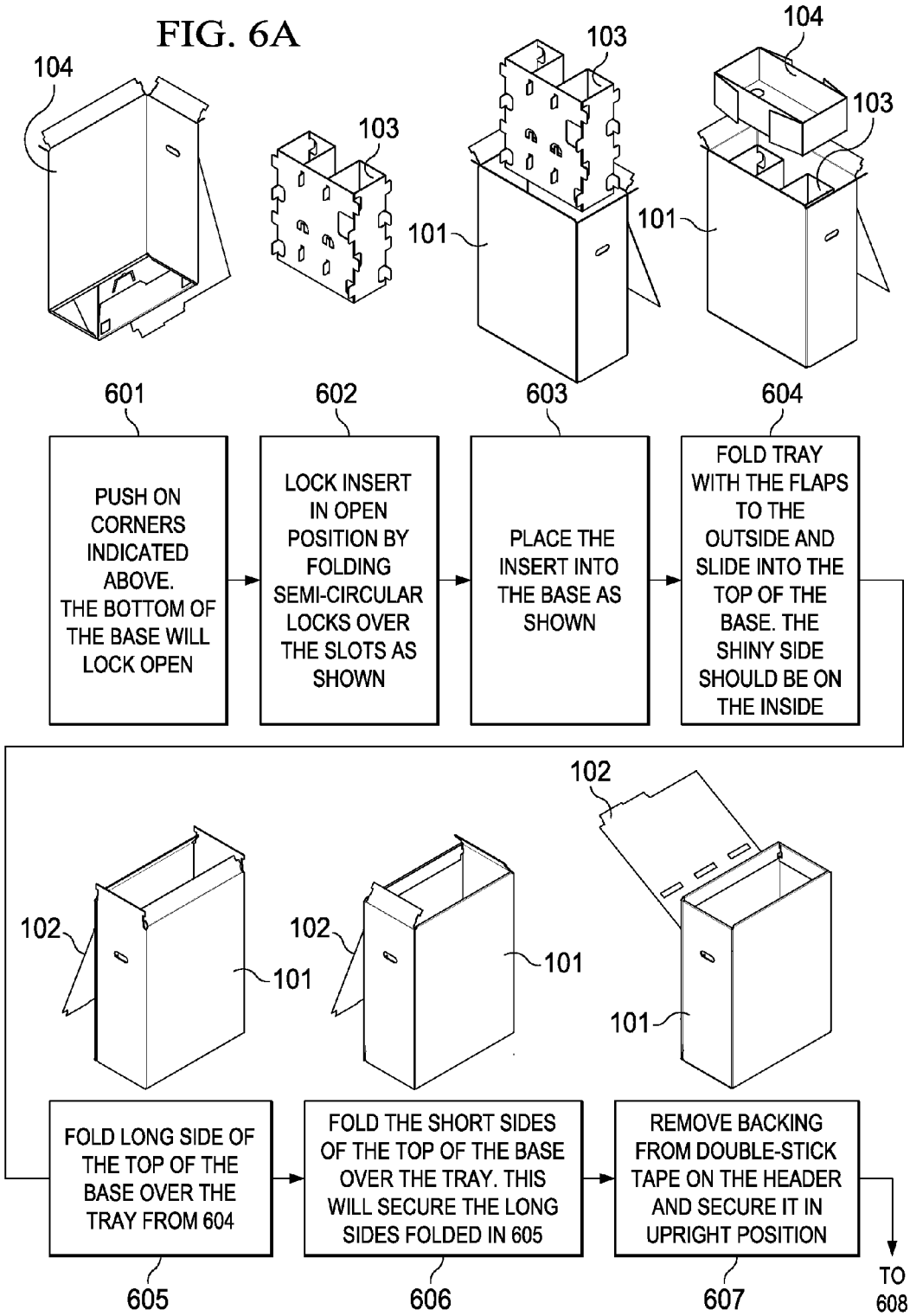
FIGS. 6A and 6B illustrate the assembly process of a disclosed embodiment of the present invention.

Following insertion of a cooler bin support 103 (FIG. 4), and the bin 104 (FIG. 5) described below with respect to FIGS. 6A-6B, the bin formation flaps are folded as described above. The first back wall insert 141 is inserted into the second second side wall slot 154, the second back wall insert 142 is inserted into the first first side wall slot 145, the first front wall insert 147 is inserted into the second first side wall slot 146, and the second front wall insert 148 is inserted into the first second side wall slot 151. Thus the cooler bin support 103 (FIG. 4) and the bin 104 (FIG. 5) are secured within the cavity formed by the cooler base 101.

The back wall is cut to form a drain flap 155, a first back wall header support 156, and a second back wall header support 157 as indicated in FIG. 2. The drain flap 155 allows for passage of a liner drain 503 (FIG. 6B). The first back wall header support 156 and the second back wall header support 157 provide support for the header 102 (see FIG. 3).

Figure 3:
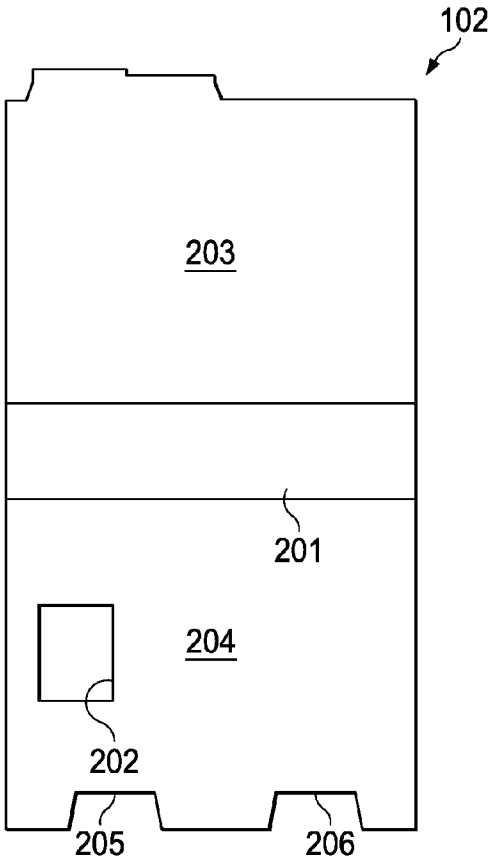
FIG. 3 is a plan view of one component of a disclosed embodiment of the present invention.

Referring now to FIG. 3, there is exemplified a sheet of corrugated fiberboard used in the assembly of the header 102 for allowing placement of graphical representations upon the system 100. The header 102 is cut to a desired shape, such as that illustrated and creased as illustrated to form a header crease 201. In the illustrated embodiment the header crease 201 divides the header 102 into a first header portion 203 and a second header portion 204. The header 102 may fold along the header crease 201 such that the header 102 may fit within the footprint of the back wall 112 of the cooler base 101. The header 102 is further cut along the indicated lines to form header drain hole 202. In the illustrated embodiment, the header drain hole 202 is the same size as the back wall drain flap 155. Finally, the header 102 is cut to define the first header support receiver 205, and the second header support receiver 206.

In the illustrated embodiment, the first back wall header support 156 (FIG. 2) fits into the second header support receiver 206, and the second back wall header support 157 (FIG. 2) fits into the first header support receiver 205, thereby partially supporting the weight of the header 102 and partially securing the header 102 to the cooler base 101. An adhesive is applied to part of the second header portion 204 between the top of the header drain hole 202 and the header crease 201. This portion of the header 102 is then secured to the corresponding area of the back wall 112 of the cooler base 101 thereby joining the header 102 to the cooler base 101 such that the location of the header drain hole 202 and the drain flap 155 correspond.

Figure 4:
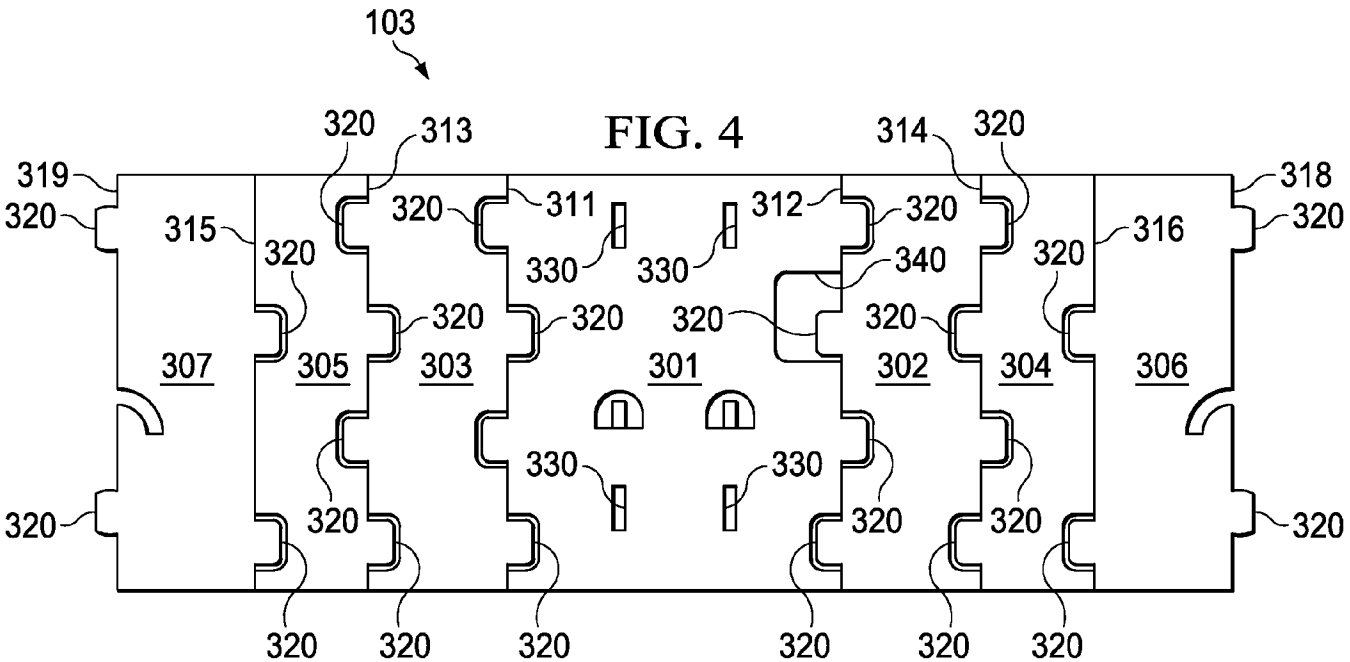
FIG. 4 is a plan view of one component of a disclosed embodiment of the present invention

Referring now to FIG. 4, there is exemplified a single sheet of corrugated fiberboard used in the assembly of the cooler bin support 103. The cooler bin support 103 further comprises a main support wall 301, a first support wall 302, a second support wall 303, a third support wall 304, a fourth support wall 305, a fifth support wall 306, and a sixth support wall 307. The first support wall 302 foldably attaches to the main support wall 301 at a first cooler bin support crease 312, and the second support wall 303 foldably attaches to the main support wall 301 opposite the first support wall 302 at a second cooler bin support crease 311. The third support wall 304 foldably attaches to the first support wall 302 opposite the main support wall 301 at a third cooler bin support crease 314, and the fourth support wall 305 foldably attaches to the second support wall 303 opposite the main support wall 301 at a fourth cooler bin support crease 313. The fifth support wall 306 foldably attaches to the third support wall 304 opposite the first support wall 302 at a fifth cooler bin support crease 316, and the sixth support wall 307 foldably attaches to the fourth support wall 305 opposite the second support wall 303 at a sixth cooler bin support crease 315.

In the illustrated embodiment, each support wall folds up toward the main support wall 301 such that a first bin support edge 318 and a second bin support edge 319 meets the main support wall 301 at main support wall slots 330. The main support wall slots 330 comprise equally sized slots cut into the main support wall 301 as illustrated. Furthermore, the cooler bin support 103 is cut along each cooler bin crease described above as illustrated to form cooler bin support inserts 320. The cooler bin support inserts 320 along each respective bin support edge 318 and 319 insert into the corresponding main support wall slots 330 when the cooler bin support 103 is in the set-up configuration (FIG. 1). Additionally, the interior cooler bin support inserts 320 along the each cooler bin crease prevent the cooler bin support 103 walls from contacting the front wall 110, the first side wall 111, the back wall 112, and the second side wall 113 of the cooler base 101 (see FIG. 2) during the set-up configuration (FIGS. 1 and 6). Finally, the cooler bin support 103 comprises a first latitudinal edge 321, and an opposing second latitudinal edge 322.

Referring now to FIG. 5, there is exemplified a single sheet of corrugated fiberboard used in the assembly of the bin 104. The bin 104 is cut and creased such that the bin 104 further comprises a bin floor 401, a bin floor drain 402, a front bin wall 403, a back bin wall 404, a first bin side wall 405, and a second bin side wall 406. The bin floor drain 402 comprises a hole cut as illustrated in FIG. 5. The front bin wall 403 is foldably attached to the bin floor 401 along a first bin crease 407. The back bin wall 404 is foldably attached to the bin floor 401 opposite the front bin wall 403 along a second bin crease 408. The first bin side wall 405 is foldably attached to the bin floor 401 along a third bin crease 409. The second bin side wall 406 is foldably attached to the bin floor 401 opposite the first bin side wall 405 along a fourth bin crease 410.

In the illustrated embodiment, the first bin side wall 405 comprises a back first bin side wall flap 411, and a front first bin side wall flap 412. The back first bin side wall flap 411 comprises a portion of the first bin side wall 405 proximate to the back bin wall 404 cut as illustrated and crease along fifth bin crease 413. The front first bin side wall flap 412 comprises a portion of the first bin side wall 405 proximate to the front bin wall 403 cut as illustrated and crease along sixth bin crease 414. Similarly, the second bin side wall 406 comprises a back second bin side wall flap 415, and a front second bin side wall flap 416. The back second bin side wall flap 415 comprises a portion of the second bin side wall 406 proximate to the back bin wall 404 cut as illustrated and crease along seventh bin crease 417. The front second bin side wall flap 416 comprises a portion of the second bin side wall 406 proximate to the front bin wall 403 cut as illustrated and creased along eighth bin crease 418.

In the preferred embodiment, the storage configuration of the bin 104 is illustrated as shown in FIG. 5. In the set-up configuration, the front wall 403 and the back wall 404 fold up such that the front (shown) portions of the corrugated fiberboard sheet comprising the bin 104 face each other. Similarly, the first side wall 405 and the second side wall 406 fold up such that the front (shown) portions of the corrugated fiberboard sheet comprising the bin 104 face each other. The back portions 411 and 415, respectively, of the first and second bin side walls 405 and 406, respectively, are placed behind the back bin wall 404 such that the front portions (shown) of the corrugated fiberboard sheet comprising the bin 104 contacts the back portion (not shown) of the corrugated fiberboard sheet comprising the bin 104 of the back wall 404. Similarly, the front portions 412 and 416, respectively, of the first and second bin side walls 405 and 406, respectively, are placed behind the front bin wall 403 such that the front portions (shown) of the corrugated fiberboard sheet comprising the bin 104 contacts the back portion (not shown) of the corrugated fiberboard sheet comprising the bin 104 of the front wall 403. Thus forming the bin 104 in the set-up configuration. In a preferred embodiment, the front of the bin 104 (shown) is coated with a water-resistant material.

Figure 6B:
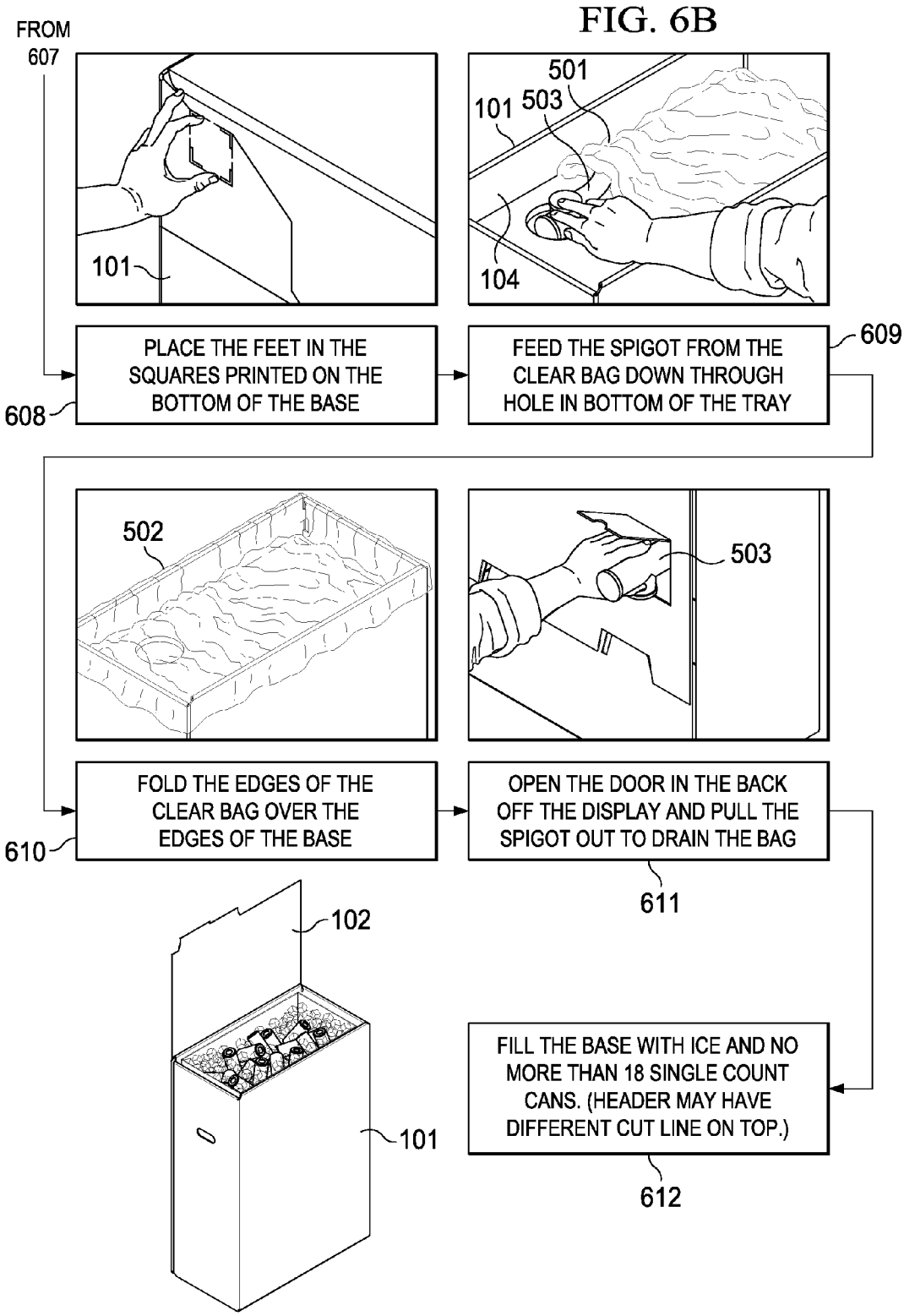

The system 100 further comprises the liner 501 (FIG. 6B) having a liner basin 502 (FIG. 6B) and the liner drain 503 (FIG. 6B). The liner basin 502 comprises a portion of the liner 501 which secures to the cooler base 104 to provide a receptacle for a coolant and articles which are to be cooled while preventing contact between the coolant and the fiberboard making up the system 100. The liner drain 503 comprises a portion of the liner 501 attached to the liner basin 502 such that a coolant placed in the liner basin 502 may drain out of the liner basin 502 leaving the liner basin 502 relatively free of coolant.

The process of bin set-up is shown in the operative steps illustrated in FIGS. 6A-6B and described below with reference to components described in FIGS. 1-5. The process begins at block 601 where opposing corners of the cooler base 101 are pressed toward each other so that the cooler base 101 moves from the flat storage configuration to the rectangular set-up position defining the cavity. The process continues at block 602 where the cooler bin support 103 is placed in set-up configuration as described above with respect to FIG. 4. Next, at block 603, the cooler bin support 103 is inserted into the cavity of the cooler base 101 such that the first latitudinal edge 321 rests on the bottom of the cooler base 101.

At block 604, the bin 104 is constructed as described above with respect to FIG. 5 and inserted into the cavity of the cooler base 101 such that the bottom of the corrugated fiberboard sheet forming the cooler bin 104 rests on the second latitudinal edge 322 of the cooler bin support 103. Next, the bin attachment flaps are folded and inserted into place as described above with respect to FIG. 2 and indicated at blocks 605 and 606. At block 607, an adhesive, such as double sided adhesive tape, is applied to a portion of the header 102 allowing the header 102 to be further secured to the cooler base 101 such that the header 102 extends above an edge of the cooler base 101 beyond the footprint of the back wall 112 of the cooler base 101. Optionally, castors may be applied to the cooler base 101 as described above with respect to FIG. 2 and indicated at block 608 of FIG. 6B.

Next, at block 609, the liner 501 is inserted into the cooler base 101 such that the liner 501 covers the bin 104. Initially, the liner drain 503 is pushed into the bin floor drain 402 allowing the liner basin 502 to cover all exposed areas of the bin 104 and extending above an edge of the cooler base 101. The portion of the liner basin 502 extending above the edge of the cooler base 101 are folded down such that the corners of the cooler base 101 secure the liner basin 502 as indicated at block 610.

At block 611, the liner drain 503 is pulled through the drain flap 155 in the back wall 112 of the cooler base 101. Finally, as indicated at block 612 a coolant, such as ice, is placed in the liner basin 502 and an article, such as cola beverages, is placed in the cooler basin 502 with the coolant allowing for display of the article while the article is kept cool.

It is understood that the present invention may take many forms and embodiments. Accordingly, several variations may be made in the foregoing without departing from the spirit or scope of the invention. For example, the size and shape of the each component can be changed to suit the particular needs of the user.

Thus the present invention embodied in the system 100 provides a disposable cooler bin having numerous advantages over prior art beverage bins. For example, the disclosed embodiments provide a cost-effective disposable beverage bin that will last the lifetime of most beverage promotions. In addition, it is space efficient in its transport, allowing many more bins to be shipped or provided to individual resellers by distributors than prior art cooler beverage bins. Furthermore, it is easy for resellers and distributor deliverers to transition from storage to set-up configuration. While the beverage bin will last the lifetime of a promotion, it will begin to decompose shortly thereafter, preventing the reseller from using the distributor provided beverage bin to display and sell products that are not the distributor's. Finally, the disclosed beverage bin is produced from recycled and recyclable materials reducing the waste produced from most prior art cooler beverage bins.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. As assembly for displaying beverages, comprising:

a first corrugated fiberboard for supporting a bin within a cavity of said first corrugated fiberboard;

a second corrugated fiberboard for displaying at least one of words, images, and shapes, wherein the second corrugated fiberboard is capable of being removably mounted to said first corrugated fiberboard;

a third corrugated fiberboard for supporting said articles placed in said bin, wherein the third corrugated fiberboard inserts within said cavity of said first corrugated fiberboard;

a fourth corrugated fiberboard for receiving said articles therein, wherein said fourth corrugated fiberboard comprises a portion of said bin and inserts within said cavity of said first corrugated fiberboard supported by said third corrugated fiberboard and secured by said first corrugated fiberboard; and a liner for insertion in said first corrugated fiberboard over said fourth corrugated fiberboard, a portion of said liner extending through said fourth corrugated fiberboard, said third corrugated fiberboard, said second corrugated fiberboard, and said first corrugated fiberboard, allowing a coolant placed within said liner to drain from said bin after cooling said articles.

2. A bin comprising:

a first corrugated fiberboard for folding between a flat storage configuration for storage thereof and a set-up configuration for supporting a bin;

a second corrugated fiberboard for folding between a said storage configuration for storage thereof and said set-up configuration for attaching to said first corrugated fiberboard and for displaying words, images, and shapes;

a third corrugated fiberboard for folding between a said storage configuration for storage thereof and said set-up configuration for insertion in said first corrugated fiberboard set-up configuration to support said articles placed in said bin;

a fourth corrugated fiberboard for folding between said storage configuration for storage thereof and said set-up configuration for insertion in said first corrugated fiberboard following insertion of said third corrugated fiberboard for receiving said articles therein; and a liner for insertion in said first corrugated fiberboard over said fourth corrugated fiberboard, a portion of said liner extending through said fourth corrugated fiberboard, said third corrugated fiberboard, said second corrugated fiberboard, and said first corrugated fiberboard, allowing a coolant to drain from said bin.

3. The bin of claim 2, wherein:

said first corrugated fiberboard defining a cavity comprising a front wall, a pair of opposing side walls foldably attached along respective proximate edges to said front wall, and a back wall foldably attached along a respective proximate edge a first wall of said pair of opposing side walls opposite said front wall;

said front wall further comprises a front wall bin formation flap configured to fold along a first front wall fold toward said back wall when said disposable bin is in said set-up configuration, and along a second front wall fold toward a bottom of said disposable bin when said disposable bin is in said set-up configuration;

said front wall bin formation flap comprising a pair of opposing front wall bin inserts attached along opposite edges of said front wall bin formation flap, wherein said front wall bin insert proximate to a respective first side wall bin formation flap slot inserts into said respective first side wall bin formation flap slot;

said front wall further comprises a front wall bottom formation flap configured to fold toward said back wall when said disposable bin is in said set-up configuration, thereby forming a portion of said bottom, wherein said front wall bottom formation flap is scored along a portion proximate to a second side wall bottom formation flap, said front wall bottom formation flap secured to said second side wall bottom formation flap such that when said disposable bin is in said storage configuration, said front wall bottom formation flap folds along said scoring allowing said disposable bin to lay relatively flat;

said first side wall further comprising a first side wall bin formation flap configured to fold along a first side wall fold toward a second side wall of said pair of opposing side walls when said disposable bin is in said set-up configuration, and along a second first side wall fold toward said bottom of said disposable bin when said disposable bin is in said set-up configuration;

said first side wall bin formation flap defines a pair of opposing first side wall slots along opposite edges of said first side wall bin formation flap, wherein a respective one of said front wall bin inserts proximate to a respective one of said first side wall bin formation flap slots inserts into said respective one of said first side wall bin formation flap slots;

said first side wall bin of said pair of opposing side walls further comprising a first side wall bottom formation flap configured to fold toward a second side wall of said pair of opposing side walls when said disposable bin is in said set-up configuration thereby forming a portion of said bottom of said disposable bin;

said second side wall of said pair of opposing side walls comprising a second side wall bin formation flap configured to fold along a first second side wall fold toward a said first side wall of said pair of opposing side walls when said disposable bin is in said set-up configuration, and along a second second side wall fold toward a bottom of said disposable bin when said disposable bin is in said set-up configuration;

said second side wall bin formation flap defining a pair of opposing second side wall slots along opposite edges of said second side wall bin formation flap, wherein a respective one of said front wall bin inserts proximate to a respective one of said second side wall bin formation flap slots inserts into said respective one of said respective second side wall bin formation flap slots;

said second side wall of said pair of opposing side walls further comprising said second side wall bottom formation flap configured to fold toward said first side wall of said pair of opposing side walls when said disposable bin is in said set-up configuration thereby forming a portion of said bottom of said disposable bin;

said back wall comprises a first attachment flap foldably attached along a respective edge of said back wall opposite said first wall of said pair of opposing side walls, wherein said first attachment flap is configured to attach to said second wall of said pair of opposing side walls when said beverage bin is in both storage and set-up configurations;

said back wall further comprises a back wall bin formation flap configured to fold along a first back wall fold toward said front wall when said disposable bin is in said set-up configuration, and along a second back wall fold toward a bottom of said disposable bin when said disposable bin is in said set-up configuration;

said back wall bin formation flap comprising a pair of opposing back wall bin inserts attached along opposite edges of said back wall bin formation flap, wherein a respective one of said back wall bin inserts proximate to a respective one of said first side wall bin formation flap slots and a one of said respective second side wall bin formation flap slots inserts into said respective one of said first side wall bin formation flap slots and said respective one of second side wall bin formation flap slots when said disposable bin is in said set-up configuration;

said back wall further comprises a back wall bottom formation flap configured to fold toward said front wall when said disposable bin is in said set-up configuration, thereby forming a portion of said bottom, wherein said back wall bottom formation flap is scored along a portion proximate to said first side wall bottom formation flap, said back wall bottom formation flap secured to said first side wall bottom formation flap such that when said disposable bin is in said storage configuration, said back wall bottom formation flap folds along said scoring allowing said disposable bin to lay relatively flat; and said back wall of said first corrugated fiberboard further comprising a pair of first corrugated fiberboard supports each formed by separating said support along three sides from said back wall, and folding away from said front wall of said first corrugated fiberboard along a respective support fold such that a side opposite said respective support fold is proximate to said bin.

4. The bin of claim 3, wherein:

said back wall of said first corrugated fiberboard further comprising a back wall drain flap for allowing said portion of said liner to pass through said back wall;

said second corrugated fiberboard comprising a hole proximate to said back wall drain flap allowing said liner drain to pass through said second corrugated fiberboard;

wherein said liner is held in place by a plurality of corners formed by said front wall, said back wall, and said pair of opposing side walls of said first corrugated fiberboard; and wherein said liner is further held in place between said back wall of said first corrugated fiberboard and said second corrugated fiberboard.

5. The bin of claim 2, wherein:

said second corrugated fiberboard cut along a first second corrugated fiberboard edge said cut forming supports that intermesh with said pair of first corrugated fiberboard supports allowing said pair of first corrugated fiberboard supports to partially support the weight of said second corrugated fiberboard; and said second corrugated fiberboard scored along a width of said second corrugated fiberboard allowing said second corrugated fiberboard to fold to fit within a footprint of said back wall of said first corrugated fiberboard, wherein said second corrugated fiberboard is attached to said back wall of said first corrugated fiberboard along said width of said second corrugated fiberboard along said score respective to said second corrugated fiberboard supports.

6. The bin of claim 2, wherein:

said third corrugated fiberboard comprising a main support wall, a first pair of opposing side support walls foldably attached along respective proximate edges to said main support wall, a second pair of opposing side support walls foldably attached along respective proximate edges to a respective first side support wall of said first pair of opposing side support walls opposite said main support wall, a third pair of opposing side support walls foldably attached along respective proximate edges to a respective side support wall of said second pair of opposing side support walls opposite said first pair of opposing support walls;

wherein said first pair of opposing side support walls fold toward a front of said main support wall, said second pair of opposing side support walls fold toward a respective opposite first side support wall, and said third pair of opposing side support walls fold into said front of said main support wall allowing a longitudinal edge of each of said third pair of opposing side support walls to contact said main support wall;

wherein each respective edge of said support wall of said third corrugated fiberboard is cut to form a plurality of a equally sized tabs for preventing contact between said third corrugated fiberboard and a respective wall of said first corrugated fiberboard;

wherein said main support wall further comprises slots cut through said main support wall, wherein said tabs on said longitudinal edge of said third pair of opposing support walls insert into said slots holding said third corrugated fiberboard in said set-up configuration; and wherein said third corrugated fiberboard is placed within said cavity of said first corrugated fiberboard such that a first latitudinal edge of said third corrugated fiberboard rests on a top of said bottom of said first corrugated fiberboard.

7. The bin of claim 2, wherein:

said fourth corrugated fiberboard comprises a bin floor, wherein said bin floor rests on a second latitudinal edge of said third corrugated fiberboard and defines a hole for passage of a liner drain;

said fourth corrugated fiberboard further comprising a pair of opposing bin ends foldably attached along respective opposite edges of said bin floor, and a pair of opposing bin sides foldably attached along respective opposite edges of said bin floor;

each one of said pair of opposing bin ends comprising a pair of opposing bin end flaps foldably attached along a respective edge of said each one of said pair of opposing bin ends;

said pair of opposing bin ends configured to fold toward a top of said bin floor, wherein said first side wall bin formation flap folds over a respective one of said pair of opposing bin ends and said second side wall bin formation flap folds over a respective one of said pair of opposing bin ends, wherein said bin end flaps proximate to a respective wall of said first corrugated fiberboard insert between said respective wall and a respective bin side of said pair of said opposing bin sides; and said pair of opposing bin sides fold toward a top of said bin floor, wherein said back wall bin formation flap folds over a respective one of said pair of opposing bin sides and said front wall bin formation flap folds over a respective one of said pair of opposing bin sides thus forming said bin.

8. A bin comprising:

a first corrugated fiberboard for folding between a flat storage configuration for storage thereof and a set-up configuration for supporting a bin;

said first corrugated fiberboard defining a cavity comprising a front wall, a pair of opposing side walls foldably attached along respective proximate edges to said front wall, and a back wall foldably attached along a respective proximate edge a first wall of said pair of opposing side walls opposite said front wall;

said front wall further comprises a front wall bin formation flap configured to fold along a first front wall fold toward said back wall when said disposable bin is in said set-up configuration, and along a second front wall fold toward a bottom of said disposable bin when said disposable bin is in said set-up configuration;

said front wall bin formation flap comprising a pair of opposing front wall bin inserts attached along opposite edges of said front wall bin formation flap, wherein said front wall bin insert proximate to a respective first side wall bin formation flap slot inserts into said respective first side wall bin formation flap slot;

said front wall further comprises a front wall bottom formation flap configured to fold toward said back wall when said disposable bin is in said set-up configuration, thereby forming a portion of said bottom, wherein said front wall bottom formation flap is scored along a portion proximate to a second side wall bottom formation flap, said front wall bottom formation flap secured to said second side wall bottom formation flap such that when said disposable bin is in said storage configuration, said front wall bottom formation flap folds along said scoring allowing said disposable bin to lay relatively flat;

said first side wall further comprising a first side wall bin formation flap configured to fold along a first side wall fold toward a second side wall of said pair of opposing side walls when said disposable bin is in said set-up configuration, and along a second first side wall fold toward said bottom of said disposable bin when said disposable bin is in said set-up configuration;

said first side wall bin formation flap defines a pair of opposing first side wall slots along opposite edges of said first side wall bin formation flap, wherein a respective one of said front wall bin inserts proximate to a respective one of said first side wall bin formation flap slots inserts into said respective one of said first side wall bin formation flap slots;

said first side wall bin of said pair of opposing side walls further comprising a first side wall bottom formation flap configured to fold toward a second side wall of said pair of opposing side walls when said disposable bin is in said set-up configuration thereby forming a portion of said bottom of said disposable bin;

said second side wall of said pair of opposing side walls comprising a second side wall bin formation flap configured to fold along a first second side wall fold toward a said first side wall of said pair of opposing side walls when said disposable bin is in said set-up configuration, and along a second second side wall fold toward a bottom of said disposable bin when said disposable bin is in said set-up configuration;

said second side wall bin formation flap defining a pair of opposing second side wall slots along opposite edges of said second side wall bin formation flap, wherein a respective one of said front wall bin inserts proximate to a respective one of said second side wall bin formation flap slots inserts into said respective one of said respective second side wall bin formation flap slots;

said second side wall of said pair of opposing side walls further comprising said second side wall bottom formation flap configured to fold toward said first side wall of said pair of opposing side walls when said disposable bin is in said set-up configuration thereby forming a portion of said bottom of said disposable bin;

said back wall comprises a first attachment flap foldably attached along a respective edge of said back wall opposite said first wall of said pair of opposing side walls, wherein said first attachment flap is configured to attach to said second wall of said pair of opposing side walls when said beverage bin is in both storage and set-up configurations;

said back wall further comprises a back wall bin formation flap configured to fold along a first back wall fold toward said front wall when said disposable bin is in said set-up configuration, and along a second back wall fold toward a bottom of said disposable bin when said disposable bin is in said set-up configuration;

said back wall bin formation flap comprising a pair of opposing back wall bin inserts attached along opposite edges of said back wall bin formation flap, wherein a respective one of said back wall bin inserts proximate to a respective one of said first side wall bin formation flap slots and a one of said respective second side wall bin formation flap slots inserts into said respective one of said first side wall bin formation flap slots and said respective one of second side wall bin formation flap slots when said disposable bin is in said set-up configuration;

said back wall further comprises a back wall bottom formation flap configured to fold toward said front wall when said disposable bin is in said set-up configuration, thereby forming a portion of said bottom, wherein said back wall bottom formation flap is scored along a portion proximate to said first side wall bottom formation flap, said back wall bottom formation flap secured to said first side wall bottom formation flap such that when said disposable bin is in said storage configuration, said back wall bottom formation flap folds along said scoring allowing said disposable bin to lay relatively flat;

said back wall of said first corrugated fiberboard further comprising a pair of first corrugated fiberboard supports each formed by separating said support along three sides from said back wall, and folding away from said front wall of said first corrugated fiberboard along a respective support fold such that a side opposite said respective support fold is proximate to said bin;

a second corrugated fiberboard for folding between a said storage configuration for storage thereof and said set-up configuration for attaching to said first corrugated fiberboard and for displaying at least one of words, images, and shapes;

said second corrugated fiberboard cut along a first second corrugated fiberboard edge said cut forming supports that intermesh with said pair of first corrugated fiberboard supports allowing said pair of first corrugated fiberboard supports to partially support the weight of said second corrugated fiberboard;

said second corrugated fiberboard scored along a width of said second corrugated fiberboard allowing said second corrugated fiberboard to fold to fit within a footprint of said back wall of said first corrugated fiberboard, wherein said second corrugated fiberboard is attached to said back wall of said first corrugated fiberboard along said width of said second corrugated fiberboard along said score respective to said second corrugated fiberboard supports;

a third corrugated fiberboard for folding between a said storage configuration for storage thereof and said set-up configuration for insertion in said first corrugated fiberboard set-up configuration to support said articles placed in said bin;

said third corrugated fiberboard comprising a main support wall, a first pair of opposing side support walls foldably attached along respective proximate edges to said main support wall, a second pair of opposing side support walls foldably attached along respective proximate edges to a respective first side support wall of said first pair of opposing side support walls opposite said main support wall, a third pair of opposing side support walls foldably attached along respective proximate edges to a respective side support wall of said second pair of opposing side support walls opposite said first pair of opposing support walls;

wherein said first pair of opposing side support walls fold toward a front of said main support wall, said second pair of opposing side support walls fold toward a respective opposite first side support wall, and said third pair of opposing side support walls fold into said front of said main support wall allowing a longitudinal edge of each of said third pair of opposing side support walls to contact said main support wall;

wherein each respective edge of said support wall of said third corrugated fiberboard is cut to form a plurality of a equally sized tabs for preventing contact between said third corrugated fiberboard and a respective wall of said first corrugated fiberboard;

wherein said main support wall further comprises slots cut through said main support wall, wherein said tabs on said longitudinal edge of said third pair of opposing support walls insert into said slots holding said third corrugated fiberboard in said set-up configuration;

wherein said third corrugated fiberboard is placed within said cavity of said first corrugated fiberboard such that a first latitudinal edge of said third corrugated fiberboard rests on a top of said bottom of said first corrugated fiberboard;

a fourth corrugated fiberboard for folding between said storage configuration for storage thereof and said set-up configuration for insertion in said first corrugated fiberboard following insertion of said third corrugated fiberboard for receiving said articles therein;

said fourth corrugated fiberboard comprises a bin floor, wherein said bin floor rests on a second latitudinal edge of said third corrugated fiberboard and defines a hole for passage of a liner drain;

said fourth corrugated fiberboard further comprising a pair of opposing bin ends foldably attached along respective opposite edges of said bin floor, and a pair of opposing bin sides foldably attached along respective opposite edges of said bin floor;

each one of said pair of opposing bin ends comprising a pair of opposing bin end flaps foldably attached along a respective edge of said each one of said pair of opposing bin ends;

said pair of opposing bin ends configured to fold toward a top of said bin floor, wherein said first side wall bin formation flap folds over a respective one of said pair of opposing bin ends and said second side wall bin formation flap folds over a respective one of said pair of opposing bin ends, wherein said bin end flaps proximate to a respective wall of said first corrugated fiberboard insert between said respective wall and a respective bin side of said pair of said opposing bin sides;

said pair of opposing bin sides fold toward a top of said bin floor, wherein said back wall bin formation flap folds over a respective one of said pair of opposing bin sides and said front wall bin formation flap folds over a respective one of said pair of opposing bin sides thus forming said bin;

a liner for insertion in said first corrugated fiberboard over said fourth corrugated fiberboard, a portion of said liner extending through said hole of said fourth corrugated fiberboard, said third corrugated fiberboard, said second corrugated fiberboard, and said first corrugated fiberboard, allowing a coolant to drain from said bin;

said back wall of said first corrugated fiberboard further comprising a back wall drain flap for allowing said portion of said liner to pass through said back wall;

said second corrugated fiberboard comprising a hole proximate to said back wall drain flap allowing said liner drain to pass through said second corrugated fiberboard;

wherein said liner is held in place by a plurality of corners formed by said front wall, said back wall, and said pair of opposing side walls of said first corrugated fiberboard;

wherein said liner is further held in place between said back wall of said first corrugated fiberboard and said second corrugated fiberboard.

9. The bin of claim 8 wherein a top of said fourth corrugated fiberboard is lined with a water resistant material.

10. The bin of claim 8 wherein a portion of said second corrugated fiberboard is cut to form geometric shapes.

11. The bin of claim 8 wherein said second corrugated fiberboard is covered with graphical images.

12. The bin of claim 8 wherein said first corrugated fiberboard is covered with graphical images.

* * * * *